United States Patent [19]

Suzuki et al.

[11] 4,219,714

[45] Aug. 26, 1980

[54] LOCK-OFF SWITCH

[75] Inventors: Hideo Suzuki, Yokohama; Touru Kasai; Ken Matsumoto, both of Kawasaki, all of Japan

[73] Assignee: Fujisoku Electric Co., Ltd., Kawasaki, Japan

[21] Appl. No.: 943,683

[22] Filed: Sep. 19, 1978

[30] Foreign Application Priority Data

Sep. 20, 1977 [JP] Japan ..... 52-126691[U]

[51] Int. Cl.[2] ..... H01H 3/20; H01H 13/08

[52] U.S. Cl. ..... 200/157; 200/321

[58] Field of Search ..... 200/157, 321, 322, 328, 200/334

[56] References Cited

U.S. PATENT DOCUMENTS

| | | | |
|---|---|---|---|
| 3,746,815 | 7/1973 | Drummer | 200/157 |
| 3,953,696 | 4/1976 | Reimann et al. | 200/328 |
| 3,971,906 | 7/1976 | Sahrbacker | 200/321 |

FOREIGN PATENT DOCUMENTS

| | | | |
|---|---|---|---|
| 2146660 | 3/1973 | Fed. Rep. of Germany | 200/322 |
| 2301522 | 7/1973 | Fed. Rep. of Germany | 200/321 |

*Primary Examiner*—Richard R. Stearns

*Attorney, Agent, or Firm*—Frishauf, Holtz, Goodman and Woodward

[57] ABSTRACT

A lock-off switch comprises a switch case, a trigger-like slider and a lock plate rockably attached to the slider and engageable therewith in a locking position so as to prevent a pulling of the trigger-like slider. A release shaft slidably penetrates into the switch case through one side thereof and is coupled to the lock plate by a coupler member. The release shaft is normally urged by a compression coil spring in such a way as to hold the lock plate in engagement with the trigger-like slider in the locked position. When the release shaft is pushed against the urging force of the compression coil spring, the coupler member moves to rock the lock plate out of the engagement with the trigger-like slider, whereby the trigger-like slider can be pulled.

8 Claims, 4 Drawing Figures

LOCK-OFF SWITCH

BACKGROUND OF THE INVENTION

This invention relates to a switch used in, for example, small electrically driven tools, and more particularly to a lock-off switch.

Varous gun-shaped electrically driven tools are known. The grip of such a tool is provided with a switch having a trigger-shaped slider. The slider is normally kept in the off-position. To drive a motor disposed in the tool, the slider is pulled by the forefinger into the on-position. So long as the slider is held in its on-position, electric power is kept supplied to the motor.

An accidental pulling of the trigger-shaped slider results in an accidental rotation of a cutter, which is very dangerous. Thus an accidental pulling of the slider should be avoided. To this end various lock-off switches have been invented. Each of these switches comprises a trigger-shaped slider and a lock means.

One known lock-off switch comprises a trigger-shaped slider and a lock pin. While held in a first position, the lock pin prevents a pulling of the slider. While kept in a second position, the lock pin can be moved perpendicularly to the axis of the tool so as to allow a pulling of the slider. Another known lock-off switch comprises a switch case, a trigger-shaped slider, a release shaft and a slightly bent leaf spring disposed in the switch case. The leaf spring is secured to the slider at one end, and its free end has a projection. While the slider is in the off-position, the projection is held in a hole made in a side of the case under an urging force of a compression spring provided beside the leaf spring, thereby preventing a pulling of the trigger-shaped slider. To allow a pulling of the slider, the release shaft is pushed to pull the projection out of the hole despite the urging force of the compression spring.

BRIEF DESCRIPTION OF THE INVENTION

An object of this invention is to provide a lock-off switch which constructionally differs from the known lock-off switches and which is more easily operated and is more reliable.

A lock-off switch according to this invention comprises a lock means rockably attached to a slider and engageable therewith in a locking position for preventing the slider from being pulled and a release means slidably penetrating into a switch case through one side thereof and coupled to the lock means. The release means is normally urged, preferably by a spring, so as to hold the lock means in engagement with the slider in the locking position. When pushed against the urging force, the release means rocks the lock means so as to disengage the lock means from the slider locking position thereof, thereby to allow the slider to be pulled.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENT

Figure 1:
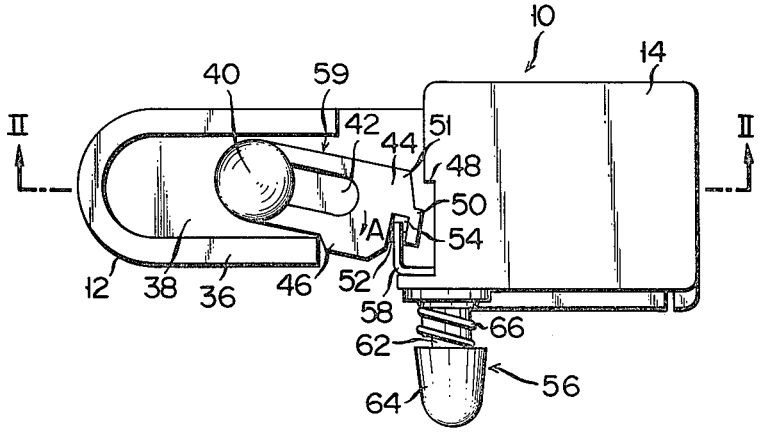
FIG. 1 is a plan view of a lock-off switch according to this invention, which is in off-position.
Figure 2:
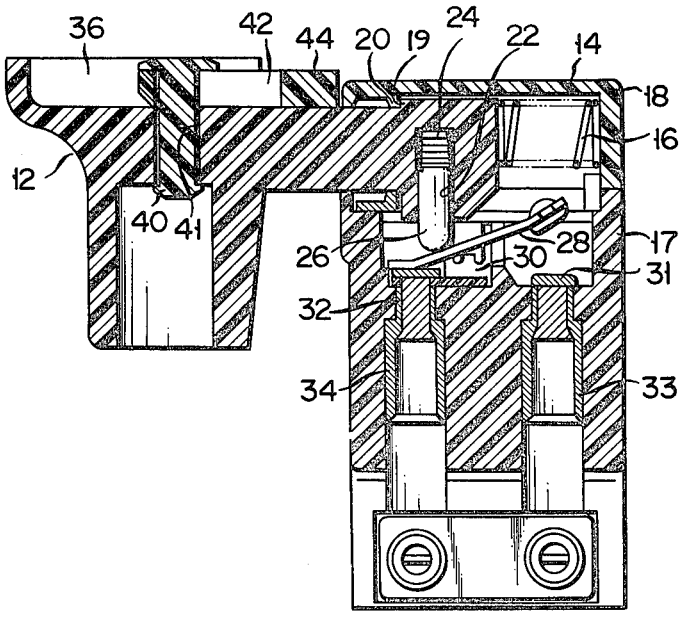
FIG. 2 is a longitudinal sectional view of the switch shown in FIG. 1, taken along line II—II in FIG. 1.

As shown in FIGS. 1 and 2, a lock-off switch 10 according to this invention comprises a trigger-shaped slider 12 slideably inserted in a switch case 14. The slider 12 is pushed from front of the case 14 by a compression spring 16 disposed in the case 14. The switch case 14 is constituted by a body 17 and a detachable cover 18. The slider 12 has a stepped portion 19 on the upper surface. The stepped portion 19 is in contact with a protrusion 20 formed on the inner surface of the cover 18, thereby preventing the slider 12 from being pushed farther by the compression spring 16. A vertical blind hole 22 is formed in the rear end portion of the slider 12 and opening downwardly. In the blind hole 22 a compression spring 24 is disposed. A pin 26 is loosely fitted in the hole 22 and urged downwardly by the compression spring 24. The rounded lower end of the pin 26 is slideably touching a movable contact 28. The movable contact 28 is supported by a fulcrum 30 at its middle portion. The movable contact 28 is rockable about the fulcrum 30 and comes into contact with a stationary on-contact 31 or a stationary off-contact 32. The stationary contacts 31 and 32 are electrically connected to terminals 33 and 34, respectively. These terminals 33 and 34 are connected to lead wires (not shown).

On the upper surface of the slider 12 a U-shaped guide frame 36 is provided to define a guide recess 38. The slider has a vertical through hole 41 which communicates with the guide recess 38. A guide pin 40 is tightly fitted in the hole 41 and is thus secured to the slider 12. A lock plate 44 is slideably mounted on the upper surface of the slider 12. The lock plate 44 has an elongated through hole 42 extending in the lengthwise direction of the slider 12 and receiving the guide pin 40.

Figure 3:
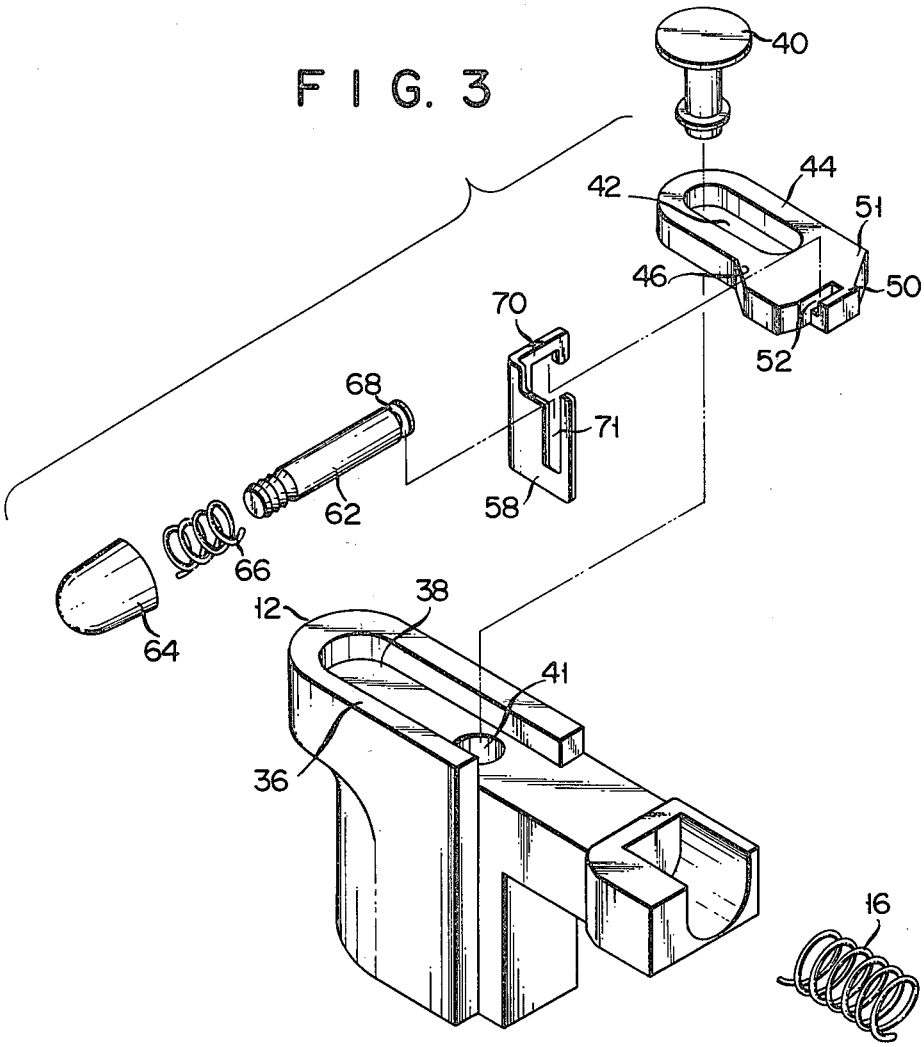
FIG. 3 is a perspective view of the primary parts of the switch shown in FIG. 1.

As shown in FIGS. 1 and 3, the lock plate 44 has an inclined side 46 which is engageable with one end of the U-shaped guide frame 36. At the rear end 51 it has a stepped portion 50 which is engageable with a stepped portion 48 formed on the front surface of the case 14. It further has a lateral groove 52 formed near the inclined side 46. At the end of the groove 52 there is formed a rectangular through hole 54 extending downwardly. In the hole 54 a hook of a release means 56 is normally inserted thereby to prevent the lock plate 44 from swinging about the guide pin 40. The guide pin 40 and the lock plate 44 constitute a lock means 59.

While the trigger-shaped slider 12 stays in off-position as shown in FIG. 1, the guide pin 40 abuts on the front end to the elongated hole 42. The lock plate 44 is swung about the guide pin 40 in the direction of arrow A until the inclined side 46 comes into contact with the end of the guide frame 36. Since the trigger-shaped slider 12 is pushed forwardly by the compression spring 16, the guide pin 40, which is tightly fitted in the vertical through hole 41 of the slider 12, pushes the lock plate 44 forwardly, thus providing a play between the lock plate 44 and the front of the case 14. This play is effectively utilized when the release means 56 is operated.

When the trigger-shaped slider 12 is pulled against the force of the compression spring 16, it moves for a stroke corresponding to said play between the lock plate 44 and the front of the case 14. Even when the rear end of the lock plate 44 comes into contact with the case 12, the movable contact 28 does not move at all and remains in contact with the stationary off-contact 32. At this time the guide frame 36 is engaged with the inclined side 46 of the lock plate 44. Thus the lock plate 44 is put into a locked state. As a result, however hard the slider 12 is pulled, it cannot be pulled further, and the lock-off switch 10 is therefore locked in the off-position.

As shown in FIG. 1, the release means 56 is provided on the side of the case 14 so as to release the lock-off switch 10 out of the off-position. The release means 56 has a release shaft 62 which extends into the case 14 through a hole (not shown) formed in the side of the case 14. It has a release button 64 at the outer end. Between the case 14 and the release button 64 a compression coil spring 66 is wound about the release shaft 62, thus urging the release button 64 and the release shaft 62 away from the case 14. The inner end portion of the release shaft 62 has an annular groove 68.

The release means 56 further comprises a coupler member 58. As shown in FIG. 3, the coupler member 58 has an L-shaped hook 70 extending at a right angle. It has an elongated slit 71 extending vertically from its upper edge. In this slit 71 the annular groove 68 of the release shaft 62 is slideably engaged, whereby the coupler member 58 is secured to the release shaft 62. The coupler member 58 is positioned in the case 14, thereby preventing the release shaft 62 from slipping out of the case 14.

The hook 70 is positioned in the lateral groove 52 of the lock plate 44 with its claw inserted in the rectangular through hole 54. Since the coupler member 58 is pushed by the spring 66 onto the inner side of the case 14, the lock plate 44 is urged by the hook 70 in the direction of arrow A as shown in FIG. 1. Namely, the lock plate 44 is swung around the guide pin 40 until its inclined side 46 comes into engagement with the guide frame 36, thereby preventing a pulling of the trigger-shaped slider 12 and thus holding the lock-off switch 10 in its off-position.

Since the hook 70 rests on the lateral groove 52 of the lock plate 44 with its claw inserted in the hole 54, the lock plate 44 would never come up. The coupler member 58 would not therefore be disengaged from the lock plate 44. This helps increase the reliability of the lock-off switch 10. The coupler member 58 swings about the release shaft 62 when the trigger-shaped slider 12 is forcibly pulled for a stroke corresponding to the play between the case 14 and the lock plate 44. Despite this swing, the coupler member 58 keeps the lock plate 44 in the locked state.

Figure 4:
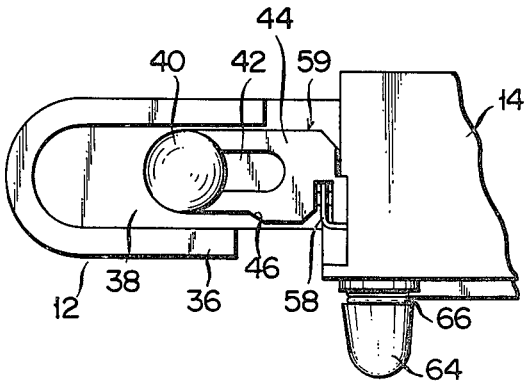
FIG. 4 is a plan view of the switch shown in FIG. 1, which can be input into on-position.

To release the lock plate 44 out of the locked state, the release button 64 is pushed against the force of the spring 66. When the button 64 is pushed, the release shaft 62 moves deeper into the case 14, and so does the coupler member 58. As the coupler member 58 moves deeper into the case 14, the hook 70 rocks the lock plate 44 about the guide pin 40 in the opposite direction to arrow A until the stepped portion 50 of the lock plate 44 comes into engagement with the stepped portion 48 of the case 14 as shown in FIG. 4. Once its stepped portion 50 has been put into engagement with the stepped portion 48 of the case 14, the lock plate 44 is axially aligned with the guide frame 36 to have its inclined side 46 disengaged from the end of the guide frame 36. As a result, the trigger-shaped slider 12 can be pulled against the force of the spring 16. As the slider 12 is pulled, the pin 26 slides on the movable contact 28 and finally puts the contact 28 into contact with the stationary on-contact 31. Thus, the lock-off switch 10 is thrown into the on-position. The guide pin 40 moves in the elongated hole 42 as the trigger-shaped slider 12 is pulled.

In the above-described lock-off switch, the lock means is rockably attached to the slider in such a manner as to prevent a pulling of the slider. The release means is provided on the side of the case and coupled to the lock means. Using an urging force applied on it, the release means normally keeps the lock means in engagement with the slider. When pushed against the urging force, the release means rocks the lock means out of engagement with the slider, thereby allowing the slider to be pulled. The lock-off switch is therefore locked automatically without fail and is released merely by pushing the release means.

What we claim is:

1. A lock-off switch comprising:

a switch case, a slider which is urged outwardly from the switch case and which can be locked at an off position, a lock means rockably attached to the slider and engageable therewith in a locking position for preventing the slider from being pulled, and a release means penetrating into the switch case through one side thereof and coupled to the lock means, said release means being normally urged so as to hold the lock means in engagement with the slider in said locking position and, when pushed against said normal urging, rocking the lock means so as to disengage the lock means from the slider locking position thereof, thereby to allow the slider to be pulled.

2. A lock-off switch according to claim 1, wherein said slider has on the top surface a guide frame defining a guide recess, and said lock means comprises:

a lock plate having an elongated hole extending in the length-wise direction and a side for engaging with the guide frame to thereby prevent the slider from being pulled, and a pin extending through the elongated hole of the lock plate for attaching the lock plate rockably to the slider, said lock plate being fully received in the guide recess when rocked by said release means.

3. A lock-off switch according to claim 2, wherein said release means comprises a release shaft extending through the side of the switch case, a spring wound about the release shaft for urging the release shaft outwardly away from the switch case and a coupler member linked to a rear end portion of the lock plate for holding the side of the lock plate in engagement with the guide frame of the slider.

4. A lock-off switch according to claim 3, wherein the lock plate of said lock means has a stepped portion at the rear end thereof facing the front of said switch case, and the front of said switch case has a stepped portion, said lock plate being able to be rocked by pushing the release means until the stepped portion of said lock plate comes into contact with the stepped portion of said switch case.

5. A lock-off switch according to claim 4, wherein:

said release shaft has an annular groove at the inner end portion thereof within said switch case;

said coupler member has an elongated slit extending downwardly from the upper edge thereof and receiving the annular groove so as to couple the coupler member to the release shaft, and an L-shaped hook extending parallel to the release shaft and having a claw extending downwardly; and said lock plate has at the rear end portion thereof an engagement means in which the claw of the L-shaped hook is normally inserted downwardly.

6. A lock-off switch according to claim 5, wherein said lock plate has at the rear end thereof a lateral groove in which the L-shaped hook is normally resting and which has said engagement means at the end.

7. A lock-off switch according to claim 4, wherein said coupler member is coupled to the inner end of said release shaft in such a manner as to prevent the release shaft from slipping out of the switch case.

8. A lock-off switch according to claim 2 wherein the lock plate of said lock means has a stepped portion at the rear end thereof facing the front of said switch case, and the front of said switch case has a stepped portion, said lock plate being able to be rocked by pushing the release means until the stepped portion of said lock plate comes into contact with the stepped portion of said switch case.

* * * * *